United States Patent [19]

Rosten et al.

[11] Patent Number: 5,060,828

[45] Date of Patent: Oct. 29, 1991

[54] DISPENSING DISPLAY PACKAGE FOR SMALL BALLS

[75] Inventors: David B. Rosten, Cambridge, Minn.; Douglas E. Foos, Barrington; Richard L. Partlow, Jr., Naperville, both of Ill.; Edward M. Berger, Chatsworth, Calif.

[73] Assignee: Plastofilm Industries, Inc., Wheaton, Ill.

[21] Appl. No.: 529,198

[22] Filed: May 25, 1990

[51] Int. Cl.[5] ..... B65D 41/00

[52] U.S. Cl. ..... 222/142.9; 222/553; 206/538

[58] Field of Search ..... 222/142.6, 142.9, 480, 222/484, 541, 545, 548, 553, 562, 565, 570; 221/263, 288; 206/532, 533, 538, 539

[56] References Cited

U.S. PATENT DOCUMENTS

| | | | |
|---|---|---|---|
| 2,206,209 | 7/1940 | Thorn | 222/548 |
| 2,327,391 | 8/1943 | Baker | 222/548 |
| 2,774,466 | 12/1956 | Liska | 206/538 |
| 2,954,148 | 9/1960 | Corrinet et al. | 206/541 |
| 3,262,614 | 7/1966 | Allen | 222/545 |
| 4,489,864 | 12/1984 | Davis | 222/565 |
| 4,583,661 | 4/1986 | Clover, Jr. | 206/538 |

*Primary Examiner*—Michael S. Huppert
*Assistant Examiner*—Shari Wunsch
*Attorney, Agent, or Firm*—Lee, Mann, Smith, McWilliams & Sweeney

[57] ABSTRACT

A thermoformed package/dispenser for bbs and other kinds of small balls has a cover rotatably mounted on a cup-shaped base to close the package or convert it into a dispenser. Detent stop structure is built in integrally with the base and cover to hold the cover in a desired open or closed package position. A knockout may be provided in the cover to package and dispense balls larger than those for which the package was primarily designed. Interlocking peripheral flanges demountably hold base and cover together with friction assured to hold the cover in a predetermined position. At least a portion of the package may be transparent so that the ball load may be observed.

8 Claims, 3 Drawing Sheets

Fig. 1
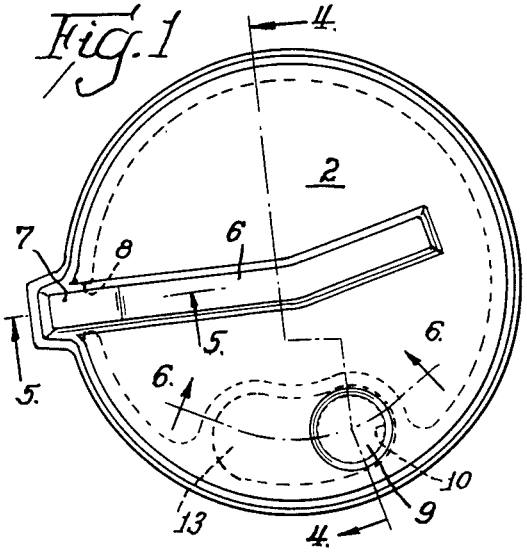
Fig. 3
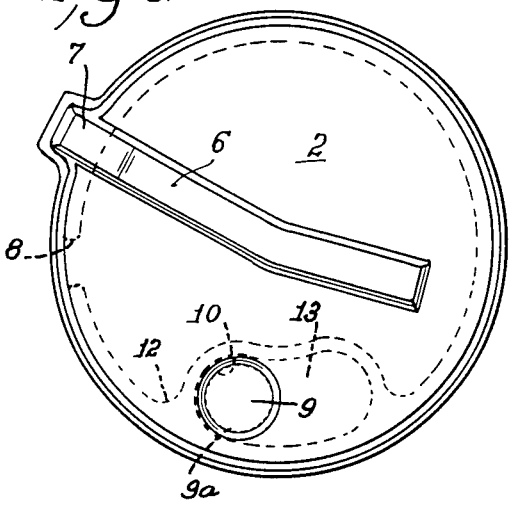
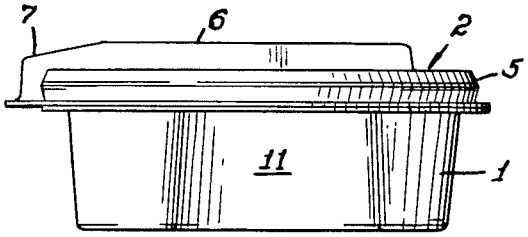
Fig. 2
Fig. 5
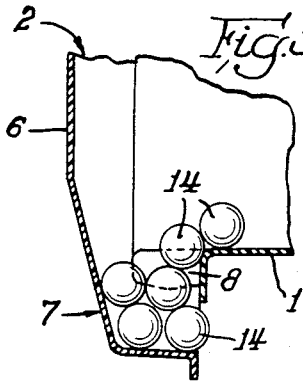
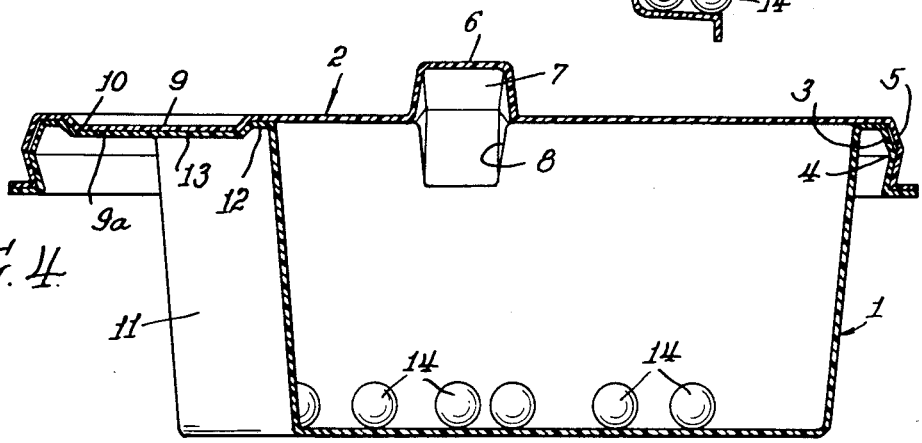
Fig. 4
Fig. 6.
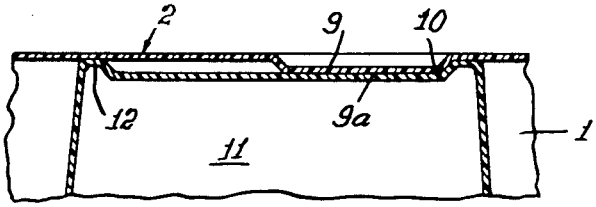

DISPENSING DISPLAY PACKAGE FOR SMALL BALLS

BACKGROUND AND SUMMARY OF THE INVENTION

Small balls of metal, ceramic or other materials are manufactured and sold for a wide variety of uses. Examples of such balls are bbs as ammunition for bb guns, slightly larger balls for use with slingshots and ball bearings for use for various purposes in mechanical equipment. Different kinds of packages, some capable of serving as dispensers, have been used for packaging such balls for distribution and sale in retail stores. When used as ammunition for hunting, target practice or just fun shooting, the packages are preferably designed for carrying in a garment to provide a supply as needed.

The object of the present invention is to provide small ball packages embodying improved features including low cost, convenient carrying and dispensing, transparent so that the number of balls remaining in the package can easily be determined, and easily manipulated closures whereby the packages may be entirely closed or made ready for controlled dispensing of the balls as desired. Each package comprises a cup-like base for containing the balls and a cover which is rotatably and removably secured to the top of the base. The base and cover are provided with openings which, when in register, permit the dispensing of balls from the package. Indexing means may be provided for indicating positions of the cover at which the package is either closed or ready for dispensing the balls. The package may be designed to contain and dispense balls larger than those for which the package was primarily intended. This may be done by providing a circular knock-out which is large enough to permit the larger sized balls to pass out from the package. The knock-out may be combined with an indexing stop button in the package cover. In an alternative embodiment, the base of the package may be divided into a plurality of pockets each of which may contain balls of a size differing from those contained in other pockets.

The several forms of package are designed to be capable of manufacture by thermoforming, a low cost method of production. Gripping means may be provided in the base and on the cover to assist in rotating the latter to a desired position for dispensing or for closing the package. In all three of the embodiments shown and described by way of example, detent means are provided for holding the cover in either a package open or closed position. This detent means includes a small circular depressed area near the periphery of the cover forming a button projecting from the underside of the cover. If desired, this depressed area may be partially punched to form a knock-out to provide an alternative package outlet. Only the planar portion of the depression is removed for this purpose the circular flange remaining to serve its function as a part of the detent means.

BRIEF DESCRIPTION OF THE DRAWINGS

In the accompanying drawings,

FIG. is a top plan view of an exemplary form of the package of the invention with the cover in the position of discharge;

FIG. 2 is a side view of the package of FIG. 1;

FIG. 3 is a top plan view of the package with the cover rotated to the closed position of the package;

FIG. 4 is a cross-sectional view of the package taken at the line 4—4 of FIG. 1 on a larger scale;

FIG. 5 is a detail view in cross section taken at the line 5—5 of FIG. 1 and showing the dispensing of the bbs;

FIG. 6 is a detail view in cross section taken at the line 6—6 of FIG. 1;

DESCRIPTION OF MODES BEST EMBODYING THE INVENTION

Figure 7:
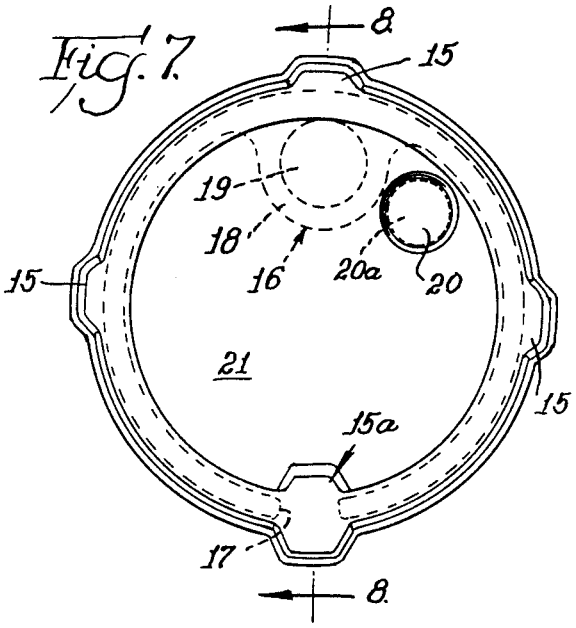
FIG. 7 is a top plan view of an alternative form of the invention with the cover in position for discharging the contents of the package.
Figure 10:
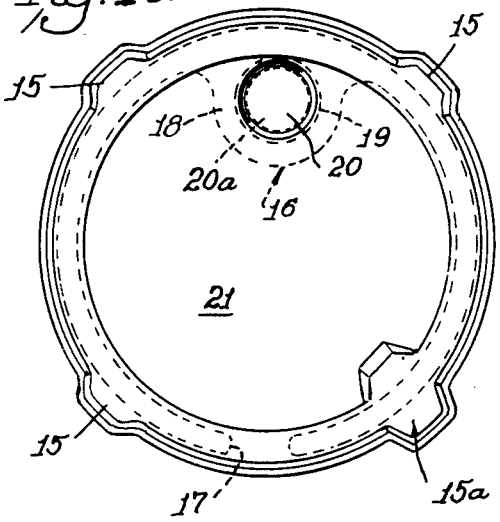
FIG. 10 is a top plan view of the package of FIG. 7 with the cover in position to close the package, and FIGS. 11 and 12 together illustrate a further alternative form of the package of the invention, FIG. 11 showing the cover in perspective and FIG. 12 showing the base of this package in perspective.
Figure 8:
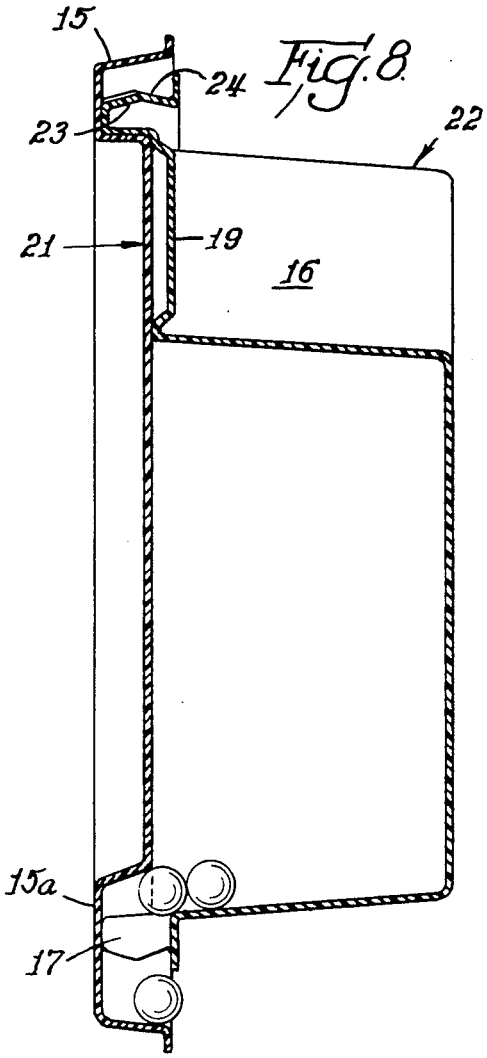
FIG. 8 is a cross-sectional view of the package of FIG. 7 taken at the line 8—8 thereof on a larger scale.
Figure 9:
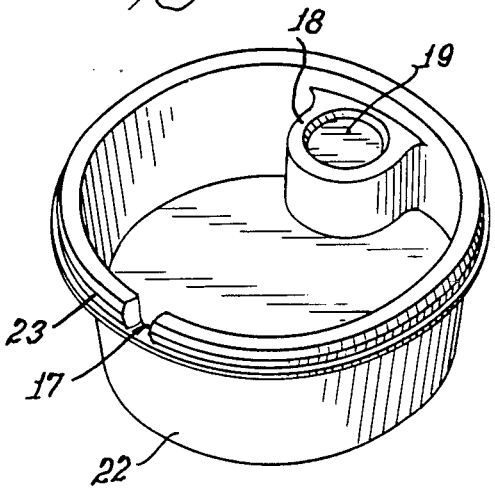
FIG. 9 is a perspective view of the uncovered base of the package of FIG. 7.

Referring, first, to the embodiment of the invention shown in FIGS. 1-6, the package is shown to embody a base 1 and a cover 2 which seats upon and closes the otherwise open top of base 1. The circular top of the base is provided with a peripheral skirt flange 3 having a bulging middle portion 4 to form a track about which cover 2 can rotate with peripheral skirt flange 5 of the cover engaging flange 3. Cover flange 5 is formed to generally mate with flange 4 with the lower portions of both flanges being in engagement to removably hold the cover in covering position upon base 1. The conformations and dimensions of the flanges are such that the cover will snap into place over the top of the base but can be removed by force manually applied to an edge of flange 5.

Preferably, in order to insure sufficient frictional engagement of the cover with the base to prevent unintended mutual rotational movement while still permitting snapping the cover onto the base and removing it therefrom when desired, the crest, i.e., the portion of maximum diameter, of the flange 5 is at a slightly higher level and greater in diameter relative to the corresponding crest of the bulging middle portion 4 of flange 3 in the closed package (see FIG. 4). This dimensional relationship establishes tight engagement of the inwardly converging lower portions of flanges 3 and 5, drawing the cover downwardly upon the base of the closed package without interference between other parts of the structure.

In thermoforming cover 2 it is provided with the functional features needed to serve as a closure for the base as a package and, when desired, to convert the package to a dispenser when it is desired to take balls from the package for use. To these ends, a generally diametrical ridge 6 is formed along the top surface of the cover to serve as a handle to turn the cover. The remote end 7 of the ridge is formed as a spout which is adapted to lead to a notch 8 in the flanged top portion of base 1 for the dispensing of balls from the package. A circular area 9 of the cover forms a depression which protrudes from the bottom of the cover as a detent button 9*a*. The central area of depression 9 is planar, as shown. This central planar portion of depression 9 is defined by a circle of tiny holes to make it possible to knock it out to provide a full opening when such an opening is desired. The rim of the depression surrounding the circle of tiny holes 10 remains intact to serve as a detent for the rotary positioning of the cover upon the base.

An indentation 11 is provided in one side of the base 1, providing a table 12 which is co-planar with the top edge of the base. An oblong, slightly arcuate depression 13 is formed in table 12 to receive button 9*a* of the cover. As is clearly shown in FIGS. 1, 3 and 4, the width of depression 13 is approximately equal to, but not less than, the full diameter of button 9*a* and the arcuity is such that the button can move from the extreme position shown in FIG. 1 to the other extremity as shown in FIG. 3. In the normal rotational operation of cover 1 of the package by means of ridge 6 as a handle, the button 9*a* and depression 9 serve as a detent, stopping the rotation at the position shown in FIG. 1, lining up spout 7 with notch 8 to open the package to the dispensing mode, as shown in FIG. 4. When the cover is rotated to the position shown in FIG. 3 the container will be closed.

The package as shown in FIGS. 1–6 may be designed and intended to package and dispense bbs 14, for example, in which case the openings at the end of spout 7 and notch 8 should be just large enough to permit the bbs to pass as is shown in FIG. 5. However, it is possible to use the same package to contain and dispense somewhat larger balls, such as slingshot ammunition, for example. For this purpose, the center part of button 9*a* would be knocked out at the ring of perforations 10. The hole so provided would be used to permit the slingshot balls to pass from the container and the aperture 8 would have no use. In the position of the cover shown in FIG. 1, the package would be completely closed and in order to permit passage of the slingshot balls from the package, sufficient force must be applied to the ridge handle 6 to slide the detent button 9*a* past the end of oblong depression 13 and over the surface of table 12 to expose the hole to the interior of the package. The plastic material of which the table is formed is sufficiently flexible to permit this action. The package may again be closed by forcing the detent button 9*a* back into the detent depression 13.

The package shown in FIGS. 7–10 as an example of a modified form of the invention is similar to that above described except that four lugs 15 protrude from the periphery of the cover to serve as grips to rotate the cover upon the base of the package. The indentation 16 also provides means for holding the base from rotating when the cover is turned. One of the four lugs, 15*a*, is larger than the rest to provide the necessary opening in the cover to provide a passageway for balls contained in the package to pass through a notch 17 when the cover is positioned for that purpose.

A table 18 is formed at the top of indentation 16 and the detent depression 19 is provided in this table. A corresponding depression 20 in the cover forms a button 20*a* protruding from the underside of the cover to cooperate with depression 19 to form detent means locating and holding the cover in position to close the package. To open the package for dispensing balls therefrom, sufficient force must be applied to the cover to slide button 20*a* over table 18 so as to line lug 15*a* up with notch 17.

In a manner similar to that described with reference to FIGS. 1–6, cover 21 may be lifted from base 22, forcing retention skirt flanges 23 and 24 apart so that the package may be reloaded when necessary and again snapped shut.

Figure 11:
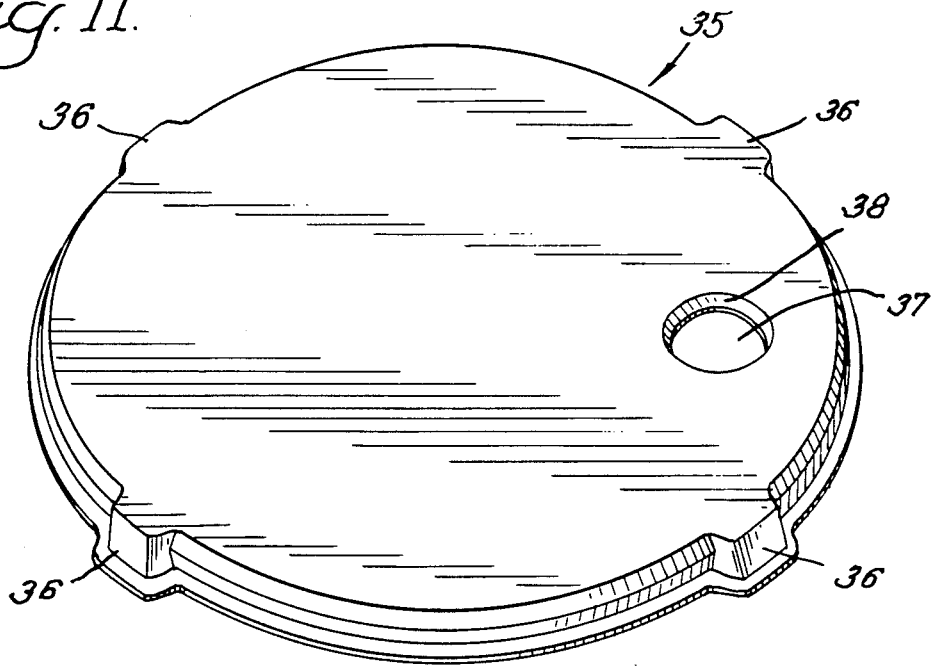
Figure 12:
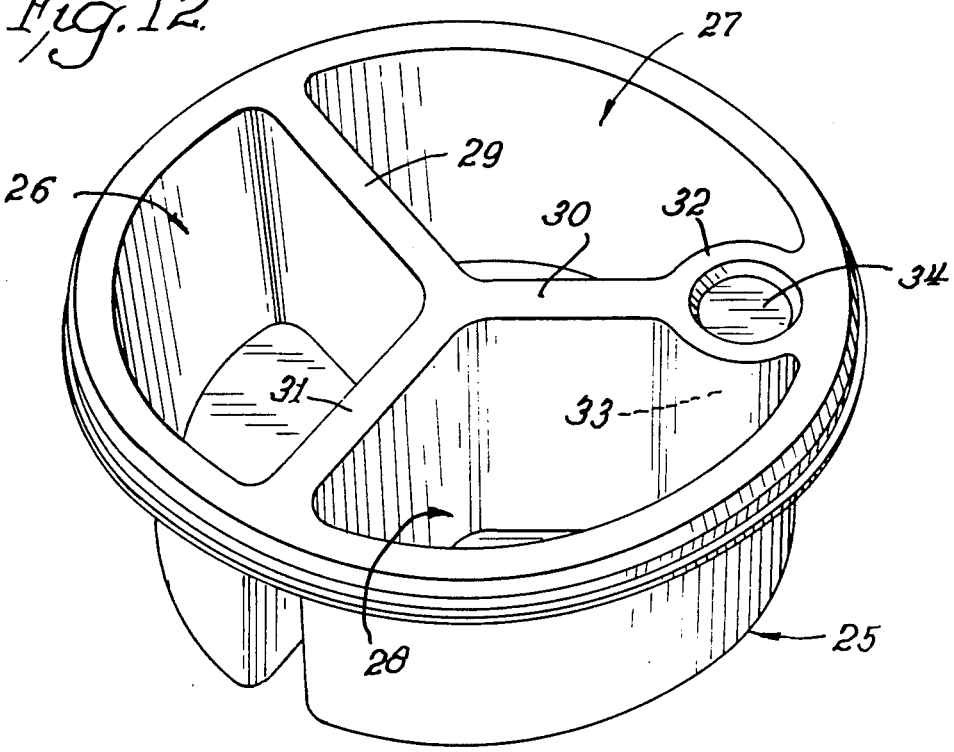

Another embodiment of the invention is illustrated in FIGS. 11 and 12. In this form of the package, base 25 is divided into three separate pockets 26, 27 and 28, being defined by walls 29, 30 and 31 which are formed integrally with the thermoformed base 25. Wall 30 has an enlarged portion forming table 32 just inwardly from the top of the base. An indentation 33 in a side of the base provides the table 32. A depression 34 is formed in table 32, as shown.

A cover 35, similar to the cover for the package illustrated in FIGS. 7–10 in that it is provided with four lugs, is provided for the base 25. In this embodiment of the invention, however, the lugs 36 are provided only to facilitate the gripping of the cover 35 to rotate the same upon base 25 to which it is retained by a skirt flange system similar to that described with reference to the other embodiments of the invention. In this case, however, a hole 37 is the only opening for dispensing balls from the package. A ring flange 38 depending from cover 35 around hole 37 is adapted to cooperate with depression 34 to form a detent to locate the cover and hold it in position to close the package. Balls may be dispensed from any one of the three pockets by rotating the cover to force separation of the detent elements and locate the hole 37 to open into the desired pocket. Balls of differing sizes may be contained in the several pockets but all must be smaller than hole 37.

We claim:

1. A dispensing display package for small balls comprising a generally cup-shaped base having a round open top and a cover therefor, fastening means for removably and rotatably securing said cover to said top of said base, said means comprising a base skirt flange spaced and depending from said top of said base, a cover skirt flange depending from the periphery of said cover overlying and in engagement with said base skirt flange, both of said skirt flanges having bulging middle portions thereof whereby the portions of said flanges below said bulging middle portions coverage inwardly to lock said cover to said base, the crest of said bulging middle portion of said cover skirt flange being at a slightly higher level and greater in diameter relative to the crest of said bulging middle portion of said base skirt flange in the closed package whereby to draw said cover downwardly upon said base, and an opening in at least said cover to permit passage of balls from within said package to the outside thereof.

2. A dispensing display package for small balls comprising a generally cup-shaped base having a round open top and a cover therefor, fastening means for removably and rotatably securing said cover to said top of said base, said means comprising a base skirt flange spaced and depending from said top of said base, a cover skirt flange depending from the periphery of said cover overlying and in engagement with said base skirt flange, both of said skirt flanges having bulging middle portions thereof whereby the portions of said flanges below said bulging middle portions coverage inwardly to lock said cover to said base, detent means for holding said cover in certain predetermined rotational positions upon said base, said detent means comprising a table formation integral with said base and substantially coplanar with and near the top thereof, said table formation having a detent depression therein with side walls defining a substantially planar bottom, said cover having a circular depression therein which protrudes from the bottom of said cover as a flat bottomed detent button adapted to seat within said detent depression whereby the movement of said cover is constrained by said side walls of said detent depression, and an opening in at least said cover to permit passage of balls from within said package to the outside thereof.

3. A dispensing display package in accordance with claim 2 wherein said table formation is sufficiently resilient and said circular depression in said cover is sufficiently shallow to permit said detent button to override said table formation to permit said cover to rotate beyond the constraints of said detent depression upon the application of sufficient rotational forces.

4. A dispensing display package in accordance with claim 2 and including a plurality of lugs at and protruding outwardly from the periphery of said cover to serve as grips to rotate said cover relatively to said base of said package and wherein the top edge portion of said base including said base skirt flange has a notch therein to form an opening through which balls from said package may pass and one of said lugs extends sufficiently beyond the periphery of said base to provide a passageway when aligned with said notch through which balls from said package may pass.

5. A dispensing display package in accordance with claim 2 wherein a generally diametrical ridge is formed in said cover to serve as a handle to turn the same relative to said base and the top edge portion of said base including said base skirt flange has a notch therein to form an opening through which balls from said package may pass, said ridge in said cover extending at one end thereof beyond the top of said base wherein to permit balls from said package to pass through said notch when said end of said ridge is located at said notch.

6. A dispensing display package in accordance with claim 5 wherein said detent means is located and arranged to permit free rotation of said cover between positions at which said end of said ridge is located at said notch or at which said end of said ridge is located elsewhere than at said notch at which position said package is closed.

7. A dispensing display package in accordance with claim 6 wherein said flat bottom of said circular depression in said cover is defined by a circle of tiny holes to make it possible to knock out said flat bottom to provide a full opening through which balls from said package may be dispensed.

8. A dispensing display package for small balls comprising a generally cup-shaped base having a round open top and a cover therefor, fastening means for removably and rotatably securing said cover to said top of said base, said means comprising a base skirt flange spaced and depending from said top of said base, a cover skirt flange depending from the periphery of said cover overlying and in engagement with said base skirt flange, both of said skirt flanges having bulging middle portions thereof whereby the portions of said flanges below said bulging middle portions converge inwardly to lock said cover to said base, detent means for holding said cover in closed position of said package, said detent means comprising a table formation integral with said base and substantially co-planar with and near the top thereof, said table formation having a circular detent depression therein, said cover having a circular hole therein approximately equal in diameter to said detent depression and defined by a shallow skirt flange depending from said cover at the periphery of said hole and adapted to seat within said detent depression, vertical partition means dividing said base into a plurality of pockets, said table formation being sufficiently resilient and said skirt flange being sufficiently shallow to permit said cover to rotate beyond the constraints of said detent depression to locate said hole in said cover to open into a selected one of said pockets to permit the passage of balls from said package.

* * * * *